US007591024B2

(12) United States Patent
Grey et al.

(10) Patent No.: US 7,591,024 B2
(45) Date of Patent: Sep. 22, 2009

(54) DORAG FOR PRESSING ON THE HAIR

(75) Inventors: Gary Grey, c/o Spartan Brands Incorporated, 220 E. 23rd St., Suite 601, New York, NY (US) 10010; Luis Rivera, San Pedro de Macoris (DO)

(73) Assignee: Gary Grey, New York, NY (US)

( * ) Notice: Subject to any disclaimer, the term of this patent is extended or adjusted under 35 U.S.C. 154(b) by 14 days.

(21) Appl. No.: 11/803,247

(22) Filed: May 14, 2007

(65) Prior Publication Data

US 2008/0282449 A1 Nov. 20, 2008

(51) Int. Cl.
*A42B 1/00* (2006.01)

(52) U.S. Cl. ..... 2/204; 2/202; 2/207

(58) Field of Classification Search ..... 2/202, 2/204, 207, 183, 174
See application file for complete search history.

(56) References Cited

U.S. PATENT DOCUMENTS

| | | | | |
|---|---|---|---|---|
| 3,561,011 | A * | 2/1971 | Gregg | 2/204 |
| 4,468,818 | A * | 9/1984 | Flannery | 2/207 |
| 5,048,128 | A * | 9/1991 | Watson, Jr. | 2/204 |
| 5,832,538 | A * | 11/1998 | Williams | 2/202 |
| 6,735,783 | B2 * | 5/2004 | Phillips | 2/202 |
| 7,200,874 | B2 * | 4/2007 | Leguenec | 2/202 |
| 2006/0048277 | A1 * | 3/2006 | Yeadon | 2/204 |

* cited by examiner

*Primary Examiner*—Gary L Welch
*Assistant Examiner*—Alissa J Tompkins
(74) *Attorney, Agent, or Firm*—Ostrolenk Faber LLP

(57) ABSTRACT

A dorag head covering including tie straps attached at the front region and being tied around the head. The front region includes a flap which is shaped generally as an inverted V triangle. The straps extend laterally off the front such that upon pulling on or tying the tie straps, the head covering is tightened down on the head, and the V-shape of the flap draws the head covering down.

4 Claims, 2 Drawing Sheets

DORAG FOR PRESSING ON THE HAIR

BACKGROUND OF THE INVENTION

Hairstyles, particularly worn by men of African descent, in the present time, may include waves in the hair. Especially when the hair normally is tightly curled, as is often the case with a man of African decent, it is often considered a desirable hairstyle for the hair to be wavy rather than tightly curled.

In order to convert curly hair to a wavy hairstyle, men with curly hair may apply a hair relaxing agent, typically a pomade, which causes tightly curled hair to relax and enables the relaxed hair to be reshaped into waves over the head in place of the curls. In order to shape the hairstyle into a wavy hairstyle, to hold the wavy hairstyle and not permit it to return to its previously curled condition, men of African descent have worn head coverings, which press on the typically pomaded hair, hold the waves and effectively "train" the hair to a wavy hairstyle.

A typical current head and hair covering worn by men of African descent is called a dorag and is often worn for maintaining and training a hairstyle or hairdo. A typical dorag consists of a thin fabric that is worn over the hair. It includes two attached and preferably integrated bands or ties which both extend out from lateral sides at the front of the dorag to wrap around the head and to be fastened together, typically by being tied behind the head. The wearer's objective is to apply the dorag as tightly as possible on the head to draw the dorag down on the hair to hold the waves, and the tie straps help do that.

An object of the present invention is to improve the application of force to tighten the dorag down on the hair.

SUMMARY OF THE INVENTION

The invention concerns placing or forming a flap on the front central region of the dorag over the center of the wearer's forehead. The flap is permanently attached to the dorag which holds the flap upraised. The flap has the general inverted V shape of a triangle and is fastened to the dorag at the top apex of the V. The flap is preferably folded up from the front edge of the dorag.

Tie straps extend off the lateral sides of the dorag at the front of the dorag, and the tie straps are outward of the inclined legs of the V or triangle. As the tie straps are tied around the head, the fabric of the dorag is tensioned and may be stretched slightly. The dorag applies pressure downwardly around the entire head. The tie straps also pull down on the dorag to tighten it around and down on the head. The tie straps also pull the legs of the triangular flap apart. This slightly flattens the triangle or inverted V somewhat, which pulls down the apex, pulls down the material at the front region of the dorag to which the triangle or V is attached, and this also pulls the front region of the dorag down on the head.

The inventor hereof initially was seeking to improve the ornamental appearance of a dorag by applying a decorative V shaped part at the front. When a sample dorag was made and tested, the V unexpectedly pulled the dorag forward at the front region and down over the forehead. This provides a valuable improvement for pulling a dorag down on the head.

Other features and advantages of the present invention will become apparent from the following description which refers to the accompanying drawings.

DETAILED DESCRIPTION OF AN EMBODIMENT OF THE INVENTION

Figure 1:
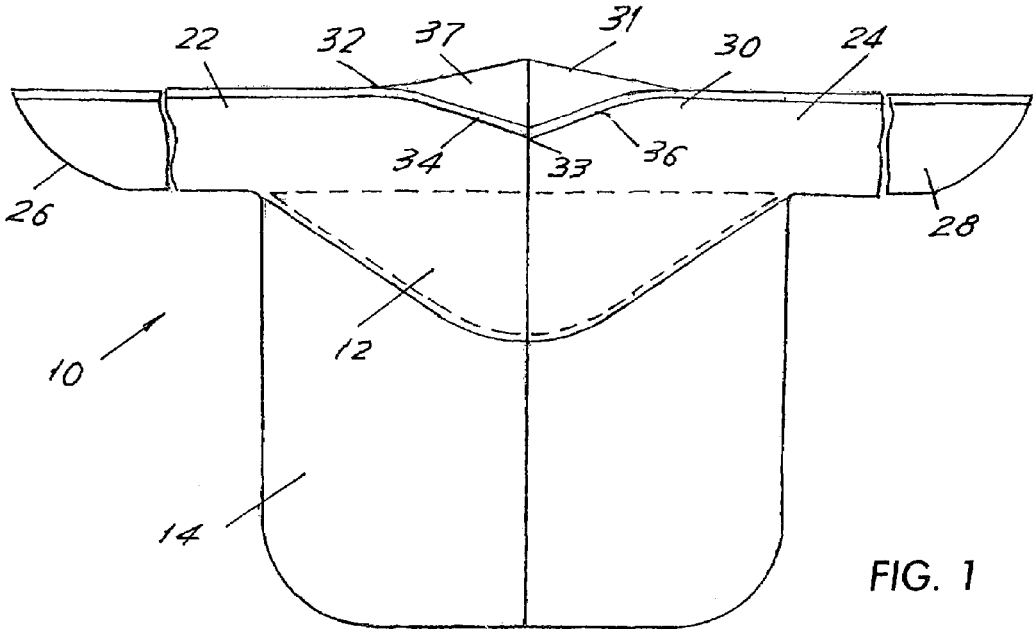
FIG. 1 is a view of a dorag from a front side to illustrate the invention.
Figure 2:
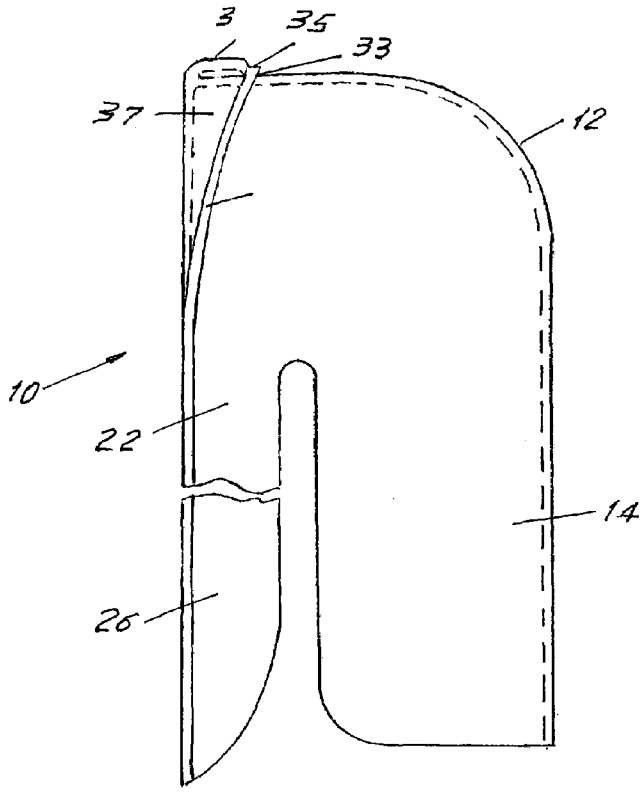
FIG. 2 is a side view showing the dorag hereof shaped as though it were being worn on a head.

FIGS. 1 and 2 show a dorag 10 according to the present invention as it appears flat or on a surface. The dorag is a kerchief-like, essentially uniform, piece of a flexible, slightly stretchable, fabric material and usually is of a material that is porous to allow the head and scalp to "breathe". It can be shaped so that its head covering, central portion 12 covers the wearer's entire head and its back region 14 includes a flap that can hang down over the back of the head and perhaps over the neck.

Left and right ties or tie straps 22 and 24 extend laterally from the opposite sides of the central front region 30 of the dorag and extend toward their respective free ends 26, 28. The tie straps are long enough (FIG. 5) to be tied around the head (FIG. 7) for holding the central portion 12 of the dorag securely on the head.

At the central front region of the dorag at 30, the dorag includes a flap 31 that is folded up from the front edge 32 of the dorag. The flap 31 is generally in the shape of an inverted V shaped triangular patch, with its apex 33 at the top and its legs 34, 36 inclined downwardly and outwardly. Its apex 33 is fastened, e.g. by being sewn at 35, to the region 30 of the dorag.

The front edge of the dorag has a continuous welting 38 on the edge of the fabric which extends over the edge of both tie straps and defines the marginal legs 34, 36 of the generally triangular-shaped flap.

Figure 3:
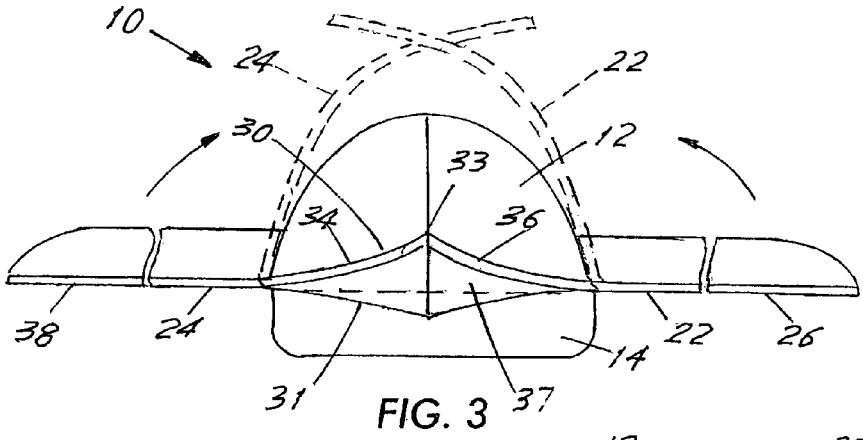
FIG. 3 is a front view and illustrates normal securement of a dorag.

FIG. 3 is a front view of a dorag as it would appear when it is on the head of a wearer. It illustrates that the tie straps 22, 24 may be tied behind the head.

Figure 4:
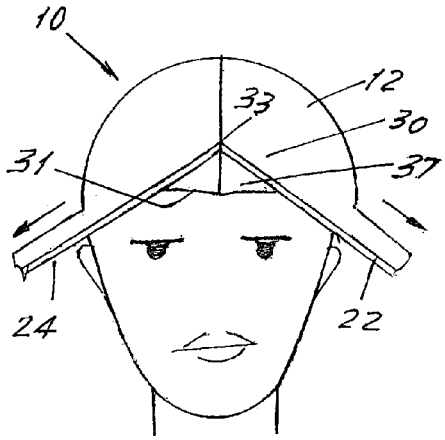
FIGS. 4-7 depicts a dorag on the head of the user and stages of its securement on the head.
Figure 6:
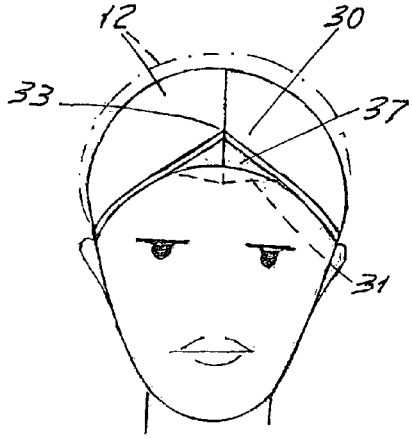
Figure 5:
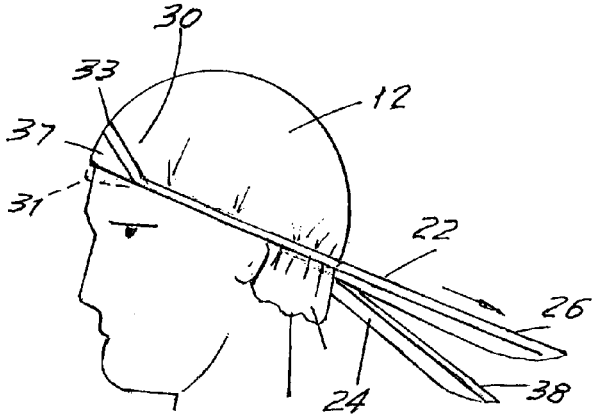
Figure 7:
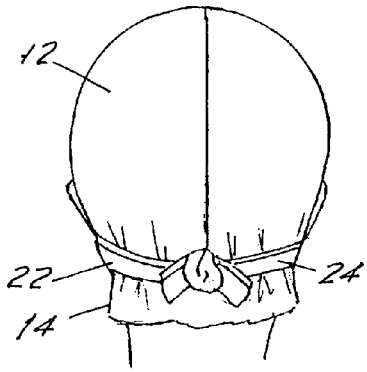

Referring to FIG. 4, the dorag is placed over the hair on the head of a wearer with the tie straps out to the side and the flap as yet untensioned and unstressed. In FIG. 5, the tie straps 22 and 44 are placed behind the head of the wearer in preparation for being tied. Then the tie straps are pulled and tied behind the head, as seen in FIG. 7. Due to the slight stretchability of the dorag, this draws the central portion 12 down, as seen in FIG. 6.

The central region 37 of the triangular flap 31 between the legs of the V-shaped triangle is drawn tight, and the legs 34, 36 of the V are pulled down as the legs 34, 36 are pulled apart by pulling on the tie straps 22 and 24, e.g., by tying them together. This draws the central front region 30 of the dorag down over the wearer's forehead as it shortens the length of the triangle from its apex to its base, as shown in FIG. 6, which shows the dorag tightened down on the head from its broken line to its solid line conditions. This draws the dorag down over the forehead at the front of the dorag and aids in tightening the dorag over the hair. When the tie straps are tied behind the head and pulled tight, as in FIG. 7, not only is the dorag held tightly on the head, as with a conventional dorag design, but because of the triangular or inverted V flap 31, the central front region 30 of the dorag is additionally pulled down, which further tightens the dorag down over the hair, to better hold the hairstyle in a desired wave form.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A dorag head covering comprising a flexible layer for being applied over the head, the layer comprising a head covering region including a front region to be worn at the front of the head and a rear region to extend at the rear of the head;

a left and right tie strap attached at the front region of the dorag, each strap extending out from the front region of the dorag and the tie straps together being long enough to be wrapped around the head of the wearer and to be tied at the rear region of the dorag to hold the dorag on the head;

a flap attached at the front region of the dorag head covering, the flap having legs that together define the general shape of a triangle or an inverted V, wherein the legs are inclined with respect to one another and meet at and define an apex of the V, the apex pointing up along the flap, and from the apex, each leg extending along the flap to a respective one of the tie straps;

the tie straps extending from the front region of the dorag and from the legs of the V such that when the dorag is worn on a wearer's head and when the tie straps are pulled or when the tie straps are tied behind the head, each tie strap also pulls on the respective leg of the flap at the respective one of the tie straps to pull the legs of the V to spread apart while remaining together at the apex, and the front region of the dorag being so shaped and the flap being so shaped and sized that when the dorag is worn on a wearer's head, the legs of the flap are permitted to spread apart relative to each other as the tie straps are pulled;

the flap of the dorag including material between the legs of the flap, the material being shaped such that with the dorag on a wearer's head and the tie straps being pulled, the legs of the V are spread apart, such that the height between the apex of the V and the connections of the legs with the tie straps is shortened, such that the flap is operative to draw the front region of the dorag down on a wearer's head, which tightens the dorag down on the head and, in cooperation with the tie straps, securely holds the dorag over the head.

2. The head covering of claim 1, wherein the flap is attached to the front region of the dorag at the apex of the triangle.

3. The head covering of claim 2, wherein the material between the legs of the flap is attached at the front region of the dorag and is folded up from the front region and is such a material and is so shaped and sized as to permit the legs to be moved apart relative to each other.

4. The head covering of claim 3, further comprising the dorag front region have a first edge; and a welting along the front edge of the dorag and extending along and over the legs of the V and the apex.

* * * * *